US008678000B2

(12) United States Patent
Ottestad

(10) Patent No.: US 8,678,000 B2
(45) Date of Patent: Mar. 25, 2014

(54) PORTABLE BREATHING APPARATUS

(75) Inventor: Nils T. Ottestad, Tonsberg (NO)

(73) Assignee: Ottestad Breathing Systems AS, Husovsund (NO)

( * ) Notice: Subject to any disclaimer, the term of this patent is extended or adjusted under 35 U.S.C. 154(b) by 1620 days.

(21) Appl. No.: 10/559,602

(22) PCT Filed: Jun. 1, 2004

(86) PCT No.: PCT/NO2004/000156

§ 371 (c)(1), (2), (4) Date: Jan. 23, 2007

(87) PCT Pub. No.: WO2004/105879

PCT Pub. Date: Dec. 9, 2004

(65) Prior Publication Data

US 2008/0029098 A1 Feb. 7, 2008

(30) Foreign Application Priority Data

Jun. 2, 2003 (NO) ..... 20032477

(51) Int. Cl.
*A62B 7/00* (2006.01)
*A62B 9/00* (2006.01)

(52) U.S. Cl.
USPC ..... 128/205.22; 128/205.12; 128/204.18; 128/204.26

(58) Field of Classification Search
USPC ..... 128/205.12, 205.24, 200.29, 201.11, 128/201.27, 200.24, 204.18, 204.26, 128/204.29, 205.18
See application file for complete search history.

(56) References Cited

U.S. PATENT DOCUMENTS

| | | | | | |
|---|---|---|---|---|---|
| 4,031,887 | A * | 6/1977 | Botos et al. | ..... | 128/205.12 |
| 4,409,978 | A * | 10/1983 | Bartos | ..... | 128/205.12 |
| 4,741,332 | A | 5/1988 | Beaussant | | |
| 4,899,740 | A * | 2/1990 | Napolitano | ..... | 128/202.22 |
| 5,265,592 | A * | 11/1993 | Beaussant | ..... | 128/201.24 |
| 5,839,436 | A * | 11/1998 | Fangrow et al. | ..... | 128/205.24 |
| 5,937,855 | A * | 8/1999 | Zdrojkowski et al. | ... | 128/205.24 |
| 6,010,118 | A * | 1/2000 | Milewicz | ..... | 261/142 |
| 6,035,851 | A * | 3/2000 | Wallen | ..... | 128/202.22 |
| 6,629,525 | B2 * | 10/2003 | Hill et al. | ..... | 128/202.26 |
| 6,817,359 | B2 * | 11/2004 | Deas et al. | ..... | 128/201.27 |
| 7,543,584 | B2 * | 6/2009 | Brookman | ..... | 128/205.11 |

* cited by examiner

*Primary Examiner* — Loan H Thanh
*Assistant Examiner* — Colin W Stuart
(74) *Attorney, Agent, or Firm* — Christian D. Abel

(57) ABSTRACT

In aspects, a portable breathing apparatus is provided that includes a face mask having a breathing valve, a blower for the supply of breathing air to the breathing valve via a supply line, a filter device for cleaning of the breathing air from the blower, and a compressed-air reservoir for alternative supply of breathing air to the breathing valve. Additionally, the breathing valve is a demand valve configured to supply pressure equal to or above an ambient pressure, a check-valve is arranged on the upstream side of the blower, and the compressed-air reservoir is provided with a pressure control valve for establishing an overpressure above the ambient pressure in the entire breathing system, wherein the pressure control valve is upstream of the breathing valve and downstream of the check valve, so that gas or liquid cannot penetrate into the system when breathing gas is supplied from the compressed-air reservoir.

3 Claims, 1 Drawing Sheet

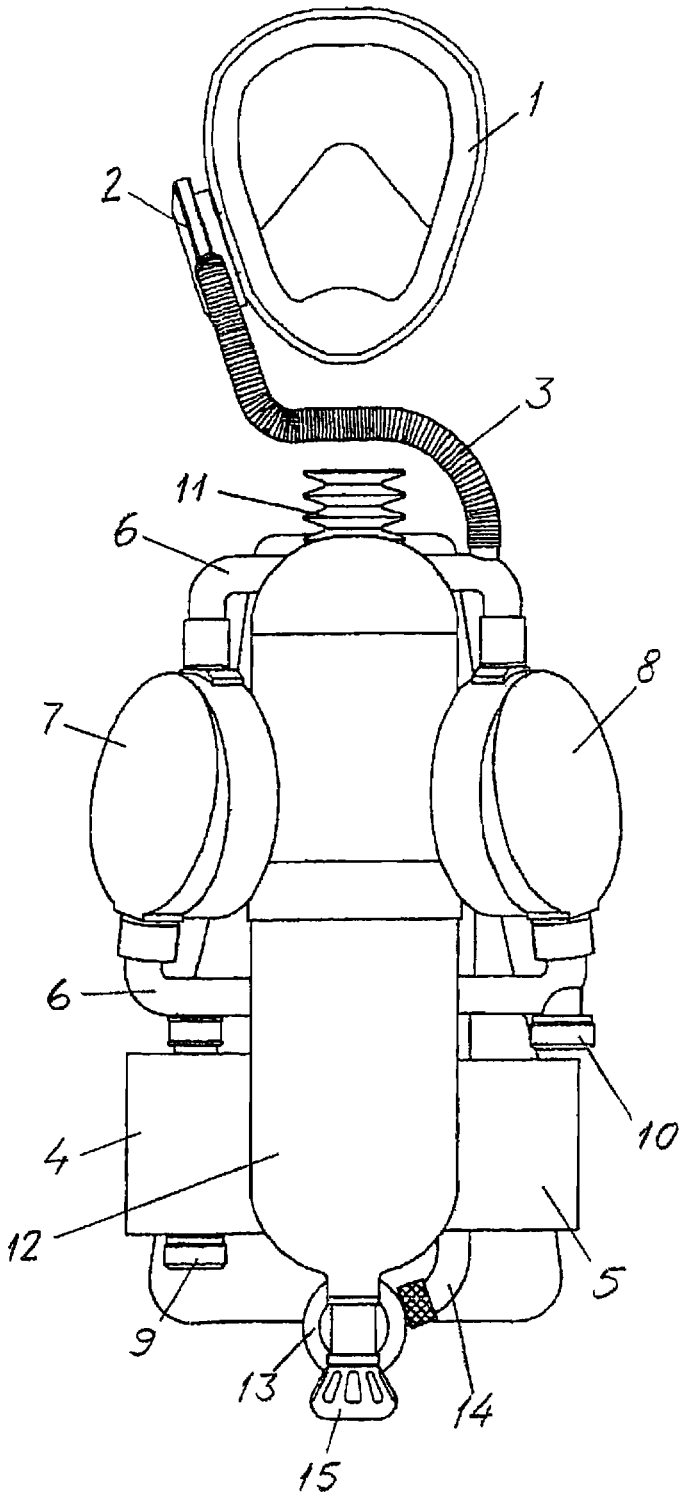
1
2
3
11
6
8
7
6
10
4
12
5
9
13
14
15

PORTABLE BREATHING APPARATUS

The invention relates to a portable breathing apparatus comprising a face mask having a breathing valve, a blower for the supply of breathing air to the breathing valve via a supply line, a filter device for cleaning of the breathing air from the blower, and a compressed-air reservoir for alternative supply of breathing air to the breathing valve.

A breathing apparatus of this type is known from DE 42 05 901 A1.

Breathing equipment based on demand-controlled supply of air from a compressed-air reservoir is a preferred technology in connection with, for example, diving and fire fighting. Breathing equipment based on removing harmful particles from the air in the surrounding atmosphere by means of special filters, has also been a known technology for many years. It is especially military authorities, the civil service etc., which base themselves on the use of gas filters. Presumably, this is due to the fact that masks and filters can be stored for a relatively long time, require a small space and provide an efficient respiration protection against most types of air contaminations, including radio active and bacteriological substances.

Breathing equipment which is based on the breathing of filtered air from the surrounding atmosphere, generally can supply much breathing air in relation to the weight of the equipment. However, the function time of a gas filter will depend on how contaminated the air is. The longest durability is obtained when using a special filter for the relevant type of contamination. Traditional filters do not absorb carbon monoxide, and do not compensate for a possible low oxygen level in the surrounding air. Therefore, in certain situations, it may be dangerous to base oneself unilaterally on breathing filtered atmospheric air. A fire in a tunnel may be such a situation. Thus, it is important for the user to have the possibility to switch to a supply from a brought-along compressed-air reservoir.

Filters for the cleaning of the breathing air have a relatively large flow resistance, and this will increase as the filter is expended. This entails that a breathing apparatus which is based on filtering of breathing air, is experienced as heavy to breathe with unless one uses an electric blower or equivalent to create a driving pressure for the supplied air. Such breathing assistance is necessary in order for the user to be able to carry out physically demanding tasks for some time with this type of breathing equipment. There have been developed battery-powered blowers for use for military personnel with special tasks. These blowers typically will be able to produce a driving pressure in the region 2-6 millibar, depending on the quantity of air passing therethrough. With the battery technology of today the blowers are given an operating time up to approximately 6 hours with relatively light batteries.

The pressure drop across a gas filter is changed considerably in accordance with the air quantity blowing through the filter. It is desirable that the pressure in the user's respiratory passages shall be stable. The systems used today are based on stabilisation of the pressure by means of a pressure relief valve which preferably is arranged in the user's mask, and which dumps excessive quantities of supplied air to the surrounding atmosphere. Thereby one also achieves establishing a relatively stable safety pressure in the mask, provided that the fan/blower has a sufficient capacity to compensate for the pressure drop at any time. The filter device is utilized not very efficiently by this way of using the blower. This is due to the fact that all the air that the blower supplies to the breathing system, passes the filter device. Consequently, this will be expended substantially more quickly than necessary.

The object of the invention is to provide a breathing apparatus which with simple means makes it possible for the user alternatively to carry out tasks under water, in oxygen-poor air and in contaminated air.

This object is achieved with a breathing apparatus of the introductorily stated type which, according to the invention, is characterised in that the breathing valve is a demand valve, that a check valve is arranged on the upstream side of the blower, and that the compressed-air reservoir is provided with a pressure control valve for establishing an overpressure in the entire breathing system upstream of the breathing valve and downstream of the check valve, so that gas or liquid from the surroundings can not penetrate into the system.

The breathing apparatus primarily is arranged in order that the user shall be able to stay for a considerable period in a contaminated atmosphere, and simultaneously have the possibility for a short effort in non-breathable surroundings. Thus, the user with a simple grip can change over the breathing apparatus for air supply from the compressed-air system, so that the user for example can carry out sea diving without any part of the breathing apparatus being damaged.

The breathing apparatus according to the invention is arranged in such a manner that one gets a favourable combination of the two above-mentioned technologies, viz. 1) demand-controlled supply of air from a compressed-air reservoir and 2) removal of harmful particles in the breathing air by means of special filters. Thus, one obtains a good respiration protection under most conditions, combined with a long operating time, low breathing work and low weight. The breathing equipment gives the user a long-time respiration protection, with the possibility to be able to carry out physically demanding tasks. In addition, for a limited time it shall be possible to carry out tasks under water or under other conditions with non-breathable surroundings.

With the breathing apparatus according to the invention, the demand-controlled breathing valve will see to it that only the air quantity inhaled by the user, passes through the filter device. In addition, in a preferred embodiment, one has chosen to allow supplied air to pass through two filters connected in parallel. These measures entail that the flow resistance through the breathing apparatus becomes more than halved, at the same time as the filter capacity is increased radically.

The invention will be further described below in connection with an exemplary embodiment with reference to the drawing of which the single FIGURE shows the main elements in a breathing apparatus according to the invention, comprising an air-filter-based primary system having a long function time, and a compressed-air-based secondary system having a shorter function time.

As shown in the drawing, the shown breathing apparatus comprises a face mask 1 having a breathing valve 2 mounted on the face mask, and a hose 3 for air supply to the breathing mask via the breathing valve.

The air-filter-based primary system comprises a blower 4 driven by current from a battery pack 5, and a divided pipe manifold 6 that is connected between the blower 4 and the supply hose 3, for carrying further the air supplied from the blower via a filter device in the form of two filter cartridges 7, 8 connected in parallel. As shown, a check valve 9 is arranged on the upstream side of the blower 4. The function of the valve will be described later. Further, an additional check valve 10 is arranged directly on the pipe manifold 6. This valve has a good capacity, and is arranged in order that the user shall get an optimally good access to air if the battery pack for the blower should become empty of current, and the compressed-air container has become empty of air.

In the illustrated embodiment there is also shown to be arranged an elastic bellows 11 which is connected to the pipe manifold 6. The bellows constitutes an elastic buffer volume which is filled with air from the blower when the breathing valve is closed, and which gives off air if the pressure upstream of the breathing valve falls below a given value.

The compressed-air-based secondary system comprises a compressed-air container 12 on which there is mounted a pressure control valve 13 that is connected to the pipe manifold 6 via a conduit 14. The compressed-air container can be opened and closed by means of a faucet comprising a screw plug 15.

When the faucet of the compressed-air container 12 is opened, the pressure control valve 13 will deliver air with an overpressure of around 0.1 bar into the pipe manifold 6. In this situation the blower 4 has no function, and its current supply is interrupted by a pressure-controlled switch (not shown). The interior of the breathing apparatus upstream of the breathing valve 2 thereby will have a 0.1 bar higher pressure than the surrounding atmosphere. If the user dives in water, the pressure in the interior of the breathing apparatus automatically will rise to a pressure that is 0.1 bar higher than the pressure in the water around the control valve 13. Both of the check valves 9 and 10 in this situation will be completely closed. Water therefore will not be able to enter and cause damage on blower, filter, etc.

In the illustrated embodiment one has chosen to use two filter cartridges which are connected in parallel. This contributes to the desired safety pressure being able to be maintained with a lesser power consumption in the blower. From energy considerations it is advantageous to connect several filter cartridges in parallel. On the other hand this will entail an increased weight and a more clumsy design.

In case of a high working load the elastic bellows 11 will contribute to the safety pressure being able to be maintained with a moderate, low power consumption in the blower. A breathing cycle can be compared to a sine curve. In that part of the breathing cycle wherein the user demands a small air supply, the delivery pressure of the blower increases and the bellows is filled with air. In that part of the breathing cycle wherein the user has a large air demand, the pressure falls upstream of the breathing valve, and the bellows gives off stored air. This entails a smoother air flow through the filter cartridges, something which in turn contributes to reducing the power consumption of the blower. To further minimize the power consumption of the blower, there may be put in an electronic control adapting the power supplied to the blower. It will not be appropriate to change the power consumption in the individual breathing cycle, but the power may be adapted to the breathing demand of the user in that the blower is supplied with the necessary power that the lowest pressure upstream of the breathing valve not being less than, for example, 3 millibar. Blower, battery pack and line connections are carried out so that they endure being surrounded by water. An additional safety detail of the preferred embodiment is that an oxygen sensor (not shown) is arranged in order to see to it that the breathing air contains a sufficient quantity of oxygen. If there is a risk that the surrounding gas may be explosive, the sensor should be connected downstream of the filter cartridges where the gas is cleaned. Similarly, also the blower should then be mounted downstream of the filter cartridges.

The breathing valve 2 is arranged to attend to demand-controlled supply of air to the user, as it normally will be adjusted to maintain a fixed, small overpressure in the mask, irrespective of whether the breathing apparatus is in the primary or secondary mode. The breathing valve is of a known type, more specifically of the design disclosed in Norwegian patent publication No. 174 120. The structure therefore will not be further described here. The valve is a pressure-balanced valve which is dimensioned so as to get the desired properties for this purpose. If the overpressure in the air supply disappears, the breathing valve—in an embodiment which is adapted for this application—will position itself in the quite open position with a flow cross-section corresponding to a pipe having an internal diameter of 20 mm. In practice this implies that the valve manages to maintain a certain safety pressure provided its upstream pressure is at least 3 millibar. The favourable properties of the valve is maintained as long as the supply pressure does not exceed ca. 0.2 bar.

The breathing apparatus is provided with a standard exhalation valve (not shown) which preferably is placed in the mask. This exhalation valve may be designated a pressure relief valve having a low opening pressure and a flat characteristic. The opening pressure typically will be set to 4 millibar. This is somewhat higher than the safety pressure which the breathing valve is arranged to maintain. In the manner the breathing apparatus according to the invention functions, it will be the flow resistance in the two parallely connected filter cartridges that limits how high the ventilation may be before the safety pressure possibly is lost.

As mentioned above, the pressure control valve 13 is arranged to regulate the pressure in the supply from the compressed-air container down to 0.1 bar. This is attended to in a reduction stage of a specially constructed valve. This will not be further described as the desired reduced pressure may be obtained by the use of known technology based on two reduction stages.

It will be desirable to produce a version of the breathing apparatus wherein the blower is not an integrated part of the apparatus, but may be connected via a quick connection. The purpose is to be able to use the apparatus with the type of blower which is mainly used today in connection with gas filters.

A breathing apparatus based on a blower, a gas filter and a demand-controlled breathing valve may also have a wide application even if the above-mentioned secondary breathing system is not included. This equipment will have a very low weight and enable a particularly demanding physical effort in situations wherein the surrounding air can be made breathable by filtering.

The invention claimed is:

1. A portable breathing apparatus comprising:

a, face mask having a demand valve, b, a blower for the supply of breathing air from an external ambient source to the demand valve via a supply line, c, a filter device for cleaning of the breathing air from the blower, and d, a compressed-air reservoir for alternative supply of breathing air to the demand valve, wherein the demand valve is configured to supply pressure equal to or above an ambient pressure, a check valve is arranged on an upstream side of the blower, and the compressed-air reservoir is provided with a pressure control valve for establishing an overpressure, above the ambient pressure upstream of the demand valve and downstream of the check valve so that gas or liquid from the surroundings can not penetrate upstream of the demand valve and downstream of the check valve when breathing gas is supplied from the compressed-air reservoir.

2. A breathing apparatus according to claim 1, wherein, upstream of the demand valve, there is arranged a bellows constituting an elastic buffer volume which is filled with air from the blower when the demand valve is closed, and which gives off air if the pressure upstream of the demand valve falls below a given value.

3. A breathing apparatus according to claim 1, wherein the filter device comprises two filter units in parallel.

* * * * *